US007386987B2

(12) United States Patent
Hirota

(10) Patent No.: US 7,386,987 B2
(45) Date of Patent: Jun. 17, 2008

(54) REFRIGERANT RELIEF DEVICE

(75) Inventor: Hisatoshi Hirota, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 371 days.

(21) Appl. No.: 11/083,024

(22) Filed: Mar. 18, 2005

(65) Prior Publication Data

US 2005/0210894 A1 Sep. 29, 2005

(30) Foreign Application Priority Data

Mar. 23, 2004 (JP) ..... 2004-084152

(51) Int. Cl.
*F25B 45/00* (2006.01)

(52) U.S. Cl. ..... 62/149

(58) Field of Classification Search ..... 62/149, 62/174, 228.1; 137/68.3
See application file for complete search history.

(56) References Cited

U.S. PATENT DOCUMENTS 3,845,791 A * 11/1974 Friendship ..... 141/6
5,673,563 A * 10/1997 Albertson et al. ..... 62/56
5,803,056 A * 9/1998 Cook et al. ..... 123/520
6,283,138 B1 * 9/2001 Friend et al. ..... 137/14

OTHER PUBLICATIONS

Mahmoud Ghodbane et al., R-152a Mobile A/C with Directed.., pp. 4-13, The Society of Automotive Engineers, 2003 Alternate Refrigerants Systems Symposium presentations (2003).

* cited by examiner

*Primary Examiner*—Melvin Jones
(74) *Attorney, Agent, or Firm*—Westerman, Hattori, Daniels & Adrian, LLP.

(57) ABSTRACT

To provide a refrigerant relief device which releases refrigerant in a refrigeration cycle to the outside of a vehicle compartment, when the refrigerant releases into the vehicle compartment, or when there is a fear that the refrigerant releases into the vehicle compartment. A metal thin film is welded in advance to a body connected to piping of a refrigeration cycle such that it blocks a refrigerant inlet passage. When leakage of refrigerant into a vehicle compartment or collision of an automotive vehicle is detected, pulse current is applied to a coil of a solenoid, whereby a movable core is attracted to a fixed core. This causes a piercing rod fixed to the movable core to pierce the metal thin film with its pointed tip to make a hole through the metal thin film. When application of the pulse current is stopped, the piercing rod is returned to the standby position by a spring, so that the refrigerant is released to the outside of the vehicle compartment by passing through a conduit via the opened hole.

12 Claims, 17 Drawing Sheets

REFRIGERANT RELIEF DEVICE

CROSS-REFERENCES TO RELATED APPLICATIONS, IF ANY:

This application claims priority of Japanese Application No. 2004-084152 filed on Mar. 23, 2004 and entitled "REFRIGERANT RELIEF DEVICE".

BACKGROUND OF THE INVENTION (1) Field of the Invention

The present invention relates to a refrigerant relief device, and more particularly to a refrigerant relief device which is mounted in a refrigeration cycle for an automotive air conditioner using a gas dangerous to a human body as refrigerant.

(2) Description of the Related Art

A typical automotive air conditioner comprises a compressor for compressing refrigerant circulating through a refrigeration cycle, a condenser for condensing the compressed refrigerant, a receiver/dryer for separating the condensed refrigerant into a gas and a liquid while temporarily storing the refrigerant circulating through the refrigeration cycle, an expansion device for restricting and expanding liquid refrigerant separated by gas/liquid separation, and an evaporator for evaporating the expanded refrigerant and returning the same to the compressor.

Although in the refrigeration cycle for an automotive air conditioner, a CFC substitute (HFC-134a) has been used as refrigerant, refrigerant with a small global warming potential has been demanded to be used from the viewpoint of global warming. As such refrigerant, there are considered e.g. carbon dioxide, HFC-152a, butane, and propane.

However, when these substances are used as refrigerant for an automotive air conditioner, if an evaporator or piping disposed in a vehicle compartment is broken to cause refrigerant release into the vehicle compartment, there is a danger of suffocation due to oxygen deficiency in the case where refrigerant is carbon dioxide, whereas in the case when refrigerant is an inflammable gas, such as HFC-152a, there is a danger of occurrence of a fire. These can have serious adverse influence on occupants.

To overcome the above problems, it is necessary to prevent refrigerant in the refrigeration cycle from releasing into the vehicle compartment, e.g. when a crack is produced in the evaporator by aging thereof, or even when components of the refrigeration cycle are seriously damaged e.g. by a collision accident.

An example of proposal to this end is to mount relief devices in advance on the respective high-pressure side and low-pressure side of the compressor of the automotive air conditioner using inflammable refrigerant, and when there occurs a collision accident to cause an airbag to be operated, operate the relief devices for releasing the inflammable refrigerant in the refrigeration cycle to the outside of the vehicle compartment (see e.g. Mahmoud Ghodbane, Ph.D., James A. Baker, William R. Hill, and Stephen O. Andersen, Ph.D., 'R-152a Mobile A/C with Directed Relief Safety System', pages 4 and 13. [online]. SAE(The Society of Automotive Engineers), 2003 Alternate Refrigerants Systems Symposium presentations Aug. 1, 2003. [retrieved on Mar. 12, 2004]. Retrieved from the Internet: <URL:http://www.sae-.org/altrefrigerant/presentations/presw-hill.pdf>).

SUMMARY OF THE INVENTION

The present invention has been made to solve the same or similar problems as disclosed in the above literature, and an object thereof is to provide a refrigerant relief device which has a specific construction capable of releasing harmful refrigerant or inflammable refrigerant in a refrigeration cycle.

To solve the above problem, there is provided a refrigerant relief device for releasing refrigerant filled in a refrigeration cycle for an automotive air conditioner into the atmosphere, including a thin film disposed in a manner blocking a refrigerant inlet passage connected to the refrigeration cycle, and a thin film-breaking section for breaking the thin film to thereby release the refrigerant introduced from the refrigeration cycle into the refrigerant inlet passage into the atmosphere.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

FIG. 1(A) is a plan view of the refrigerant relief device, and FIG. 1(B) is a front view of the refrigerant relief device.

FIG. 11(A) is a plan view of the refrigerant relief device, and FIG. 11(B) is a central longitudinal cross-sectional view of the internal construction of the refrigerant relief device.

DESCRIPTION OF THE PREFERRED EMBODIMENTS

Hereinafter, embodiments of the present invention will be described in detail with reference to the drawings.

Figure 1A:
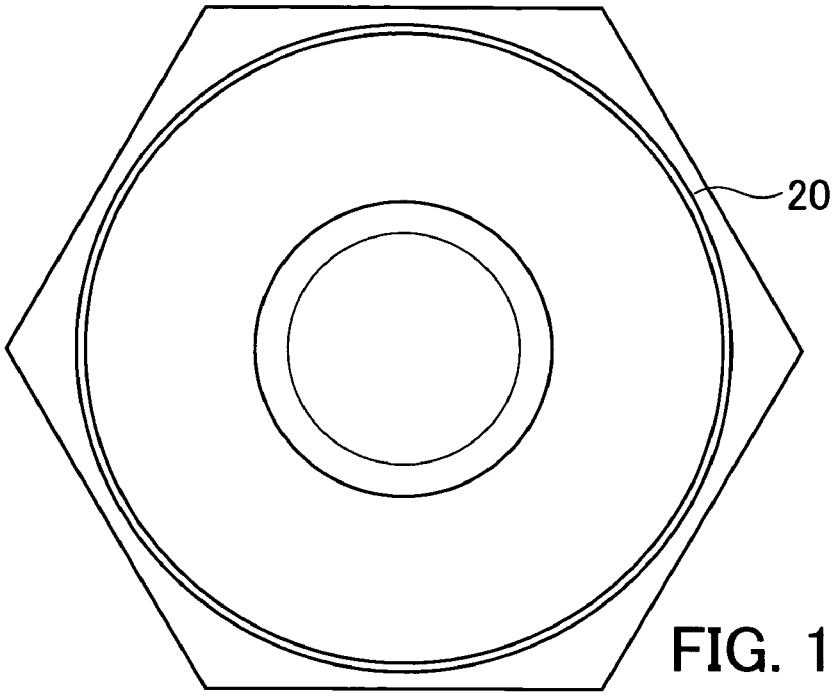
FIGS. 1(A) and 1(B) are diagrams showing general views of a refrigerant relief device according to a first embodiment.
Figure 1B:
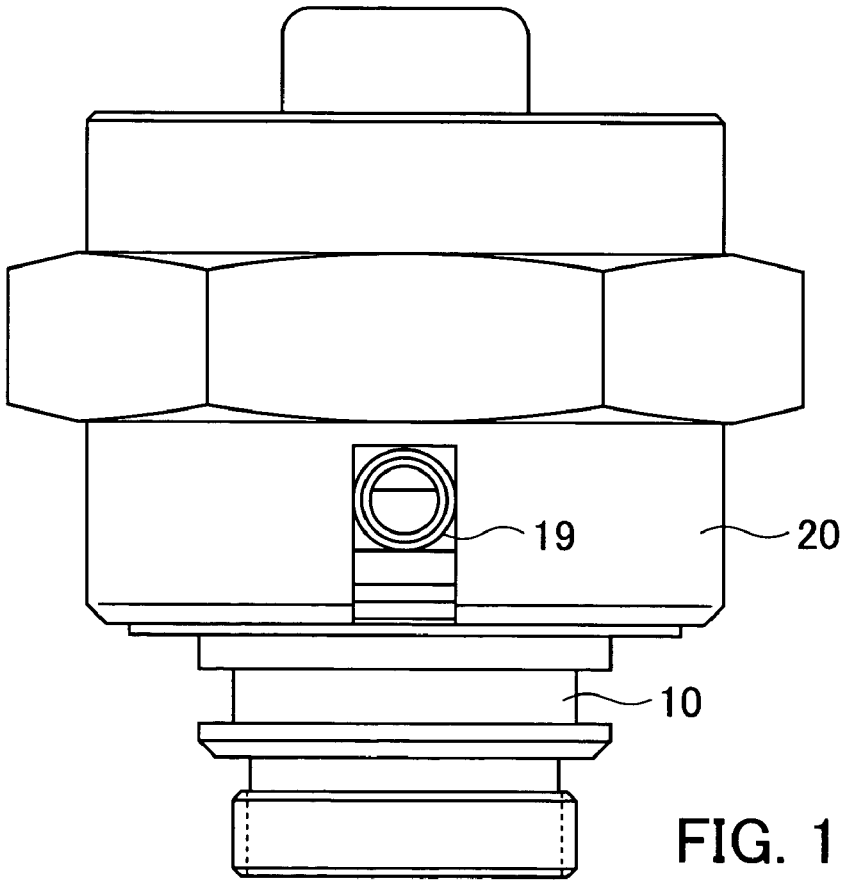
Figure 2:
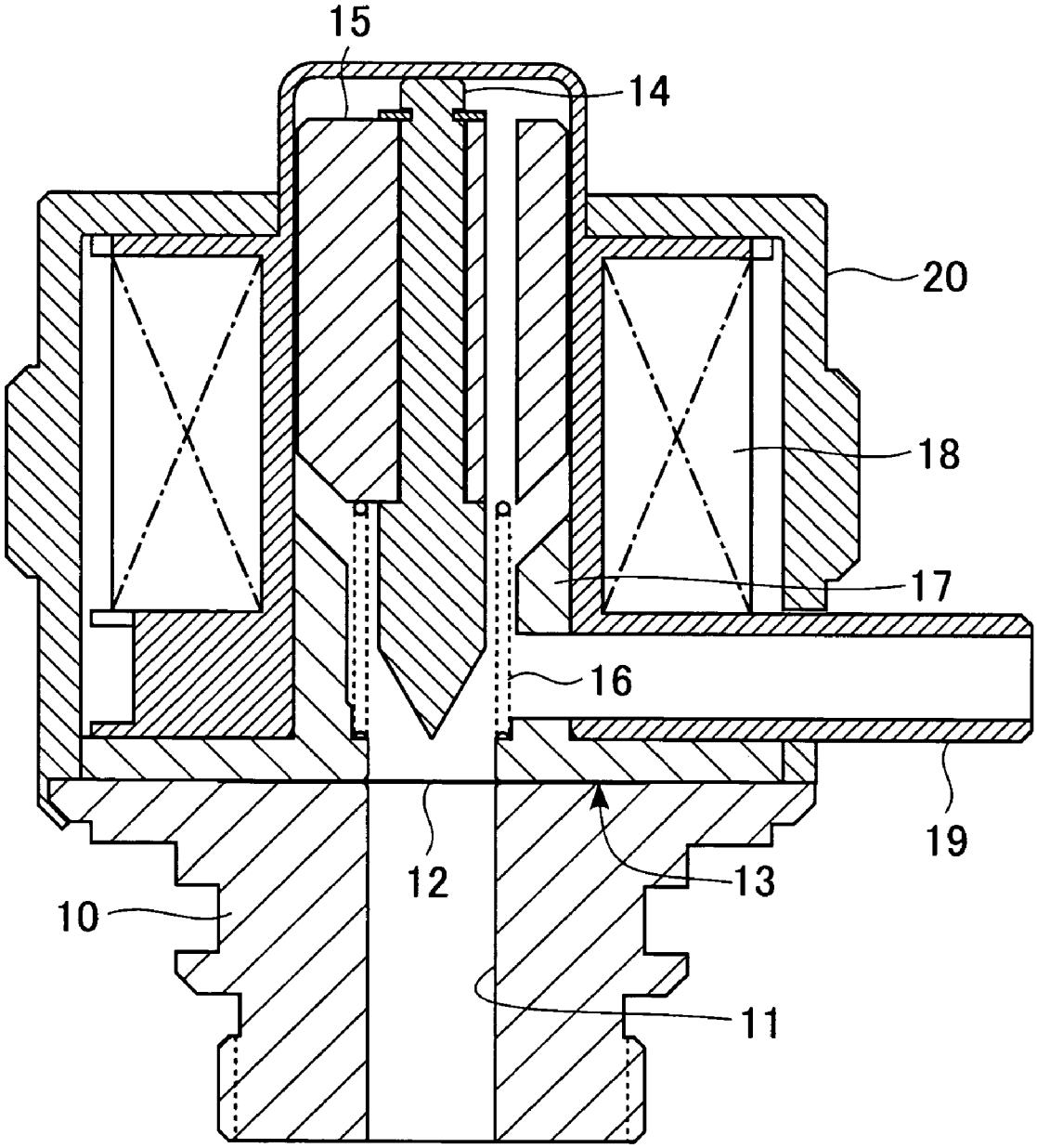
FIG. 2 is a central longitudinal cross-sectional view of the internal construction of the refrigerant relief device according to the first embodiment.

FIGS. 1(A) and 1(B) are diagrams showing general views of a refrigerant relief device according to a first embodiment of the present invention, in which FIG. 1(A) is a plan view of the refrigerant relief device, and FIG. 1(B) is a front view of the refrigerant relief device. FIG. 2 is a central longitudinal cross-sectional view of the internal construction of the refrigerant relief device according to the first embodiment.

The refrigerant relief device includes a body 10 forming a joint for connection to piping of a refrigeration cycle, and the body 10 has a refrigerant inlet passage 11 formed therethrough in the direction of a central axis thereof. The body 10 has a metal thin film 12 disposed on an upper surface thereof, as viewed in FIG. 2, in a manner blocking the refrigerant inlet passage 11. The metal thin film 12 is welded to the body 10 e.g. by laser welding along a concentric circle passing through a point 13 outward of the refrigerant inlet passage 11, whereby the metal thin film 12 is hermetically sealed to the body. 10 along the whole circumference thereof.

Disposed above the body 10, as viewed in FIG. 2, is a solenoid forming a thin film-breaking section. More specifically, a piercing rod 14 is disposed in a manner movable forward and backward in a direction perpendicular to the plane of the metal thin film 12. This piercing rod 14 has a tip facing the metal thin film 12 formed such that it has a pointed shape, and is rigidly fixed to a movable core 15 of the solenoid. The movable core 15 is urged by a spring 16 in a direction away from a fixed core 17. The fixed core 17 has a hole axially formed therethrough for arranging the piercing rod 14 and the spring 16 therein. The fixed core 17 has a lower end, as viewed in FIG. 2, which is integrally formed with a flange portion protruding radially outward for establishing a magnetic circuit, and further provided with a horizontal hole for permitting refrigerant to escape to the atmosphere.

Disposed around the outer peripheries of the movable core 15 and the fixed core 17 is a coil 18. A bobbin for the coil 18 has a container for containing the movable core 15 and the fixed core 17, and a conduit 19 for releasing refrigerant into the atmosphere, the container and the conduit 19 being integrally formed with the bobbin e.g. by a resin. The refrigerant relief device is attached to refrigerant piping in an engine room, and if the location where the refrigerant relief device is attached is not suitable for releasing refrigerant, a hose may be connected to the conduit 19, to thereby guide refrigerant to a suitable location for releasing refrigerant. Outside the coil 18, a yoke 20 for establishing the magnetic circuit is disposed, and fixed to the body 10 by caulking. The yoke 20 is formed such that the outer periphery thereof has a shape of nut, in view of its connection to the piping of the refrigeration cycle.

Next, the operation of the refrigerant relief device constructed as above will be described with reference to FIG. 3 and FIG. 4.

Figure 3:
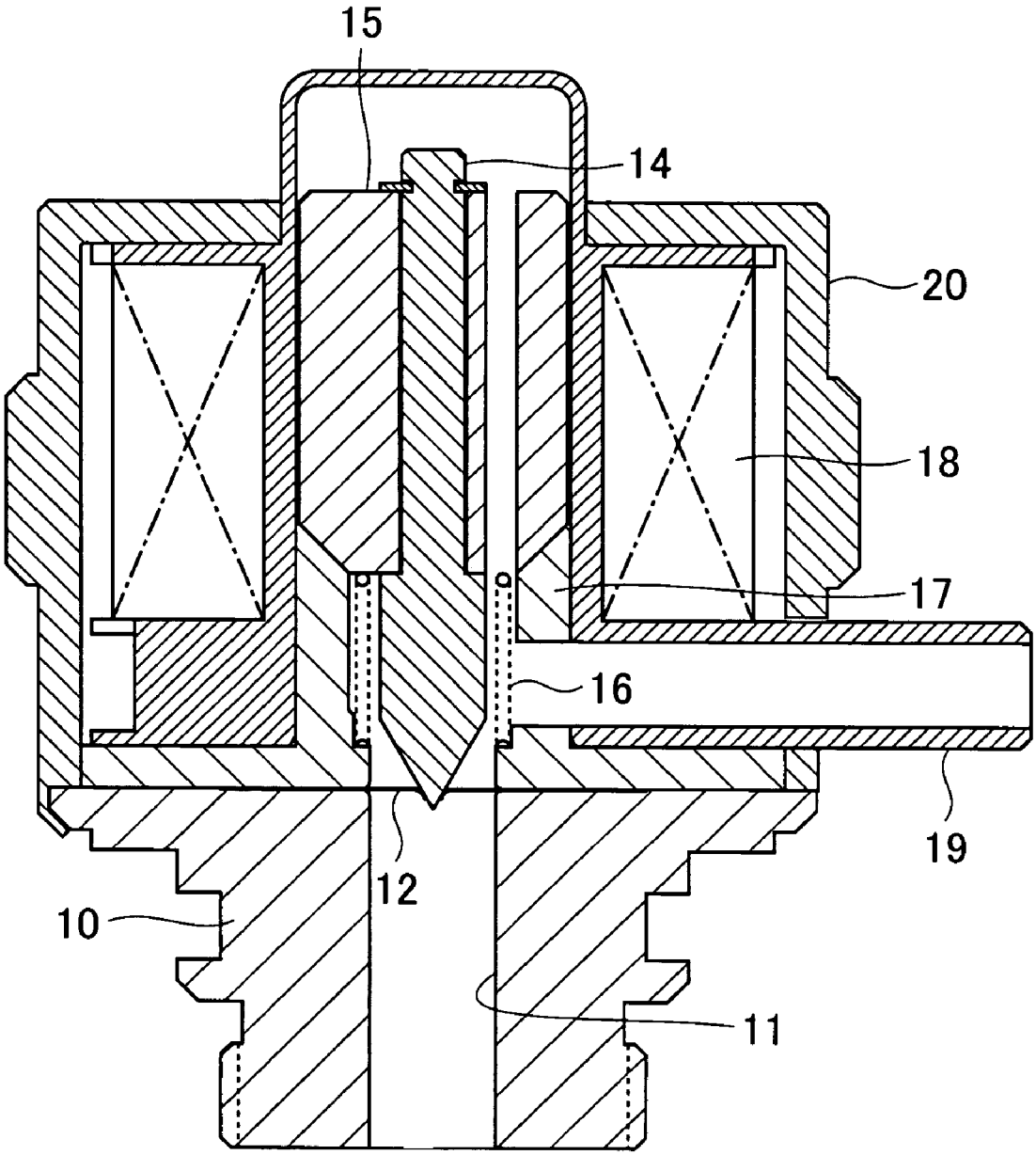
FIG. 3 is a central longitudinal cross-sectional view of the refrigerant relief device according to the first embodiment, in an energized state.
Figure 4:
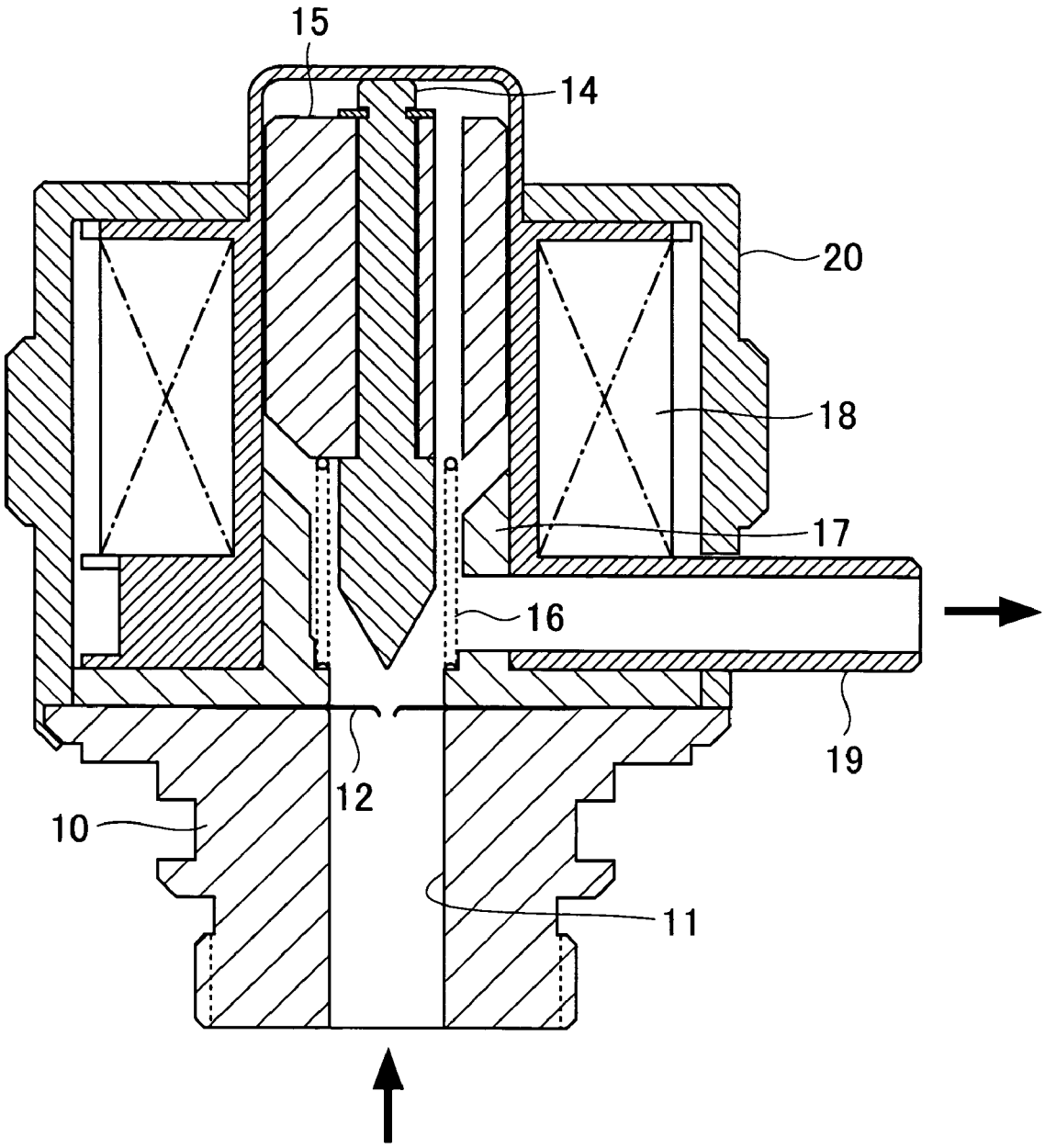
FIG. 4 is a central longitudinal cross-sectional view of the refrigerant relief device according to the first embodiment, in a non-energized state.
Figure 5:
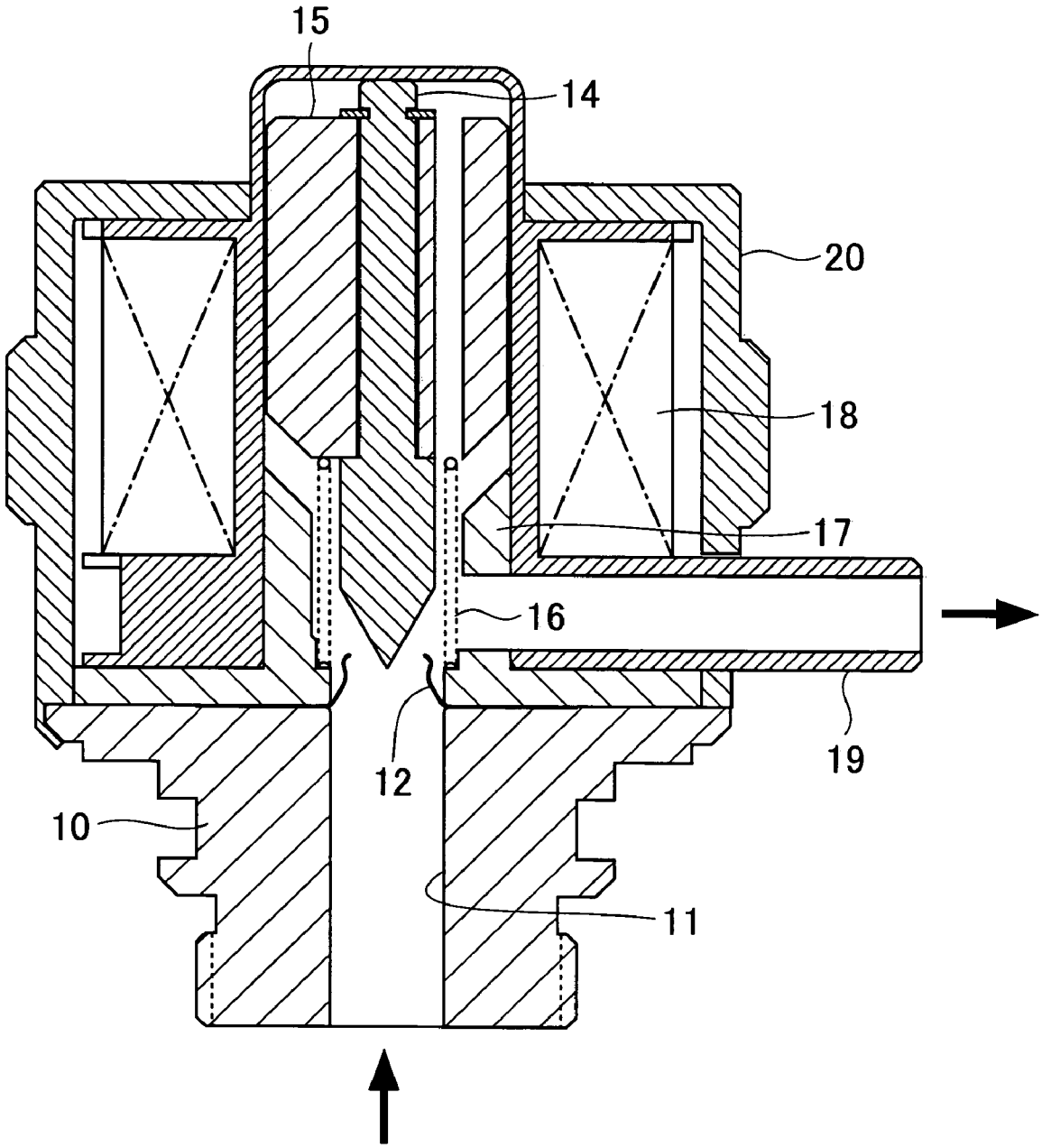
FIG. 5 is a central longitudinal cross-sectional view of the refrigerant relief device according to the first embodiment, in a refrigerant-relieving state.

FIG. 3 is a central longitudinal cross-sectional view of the refrigerant relief device according to the first embodiment, in an energized state, and FIG. 4 is a central longitudinal cross-sectional view of the refrigerant relief device according to the first embodiment, in a deenergized state. FIG. 5 is a central longitudinal cross-sectional view of the refrigerant relief device according to the first embodiment, in a refrigerant-relieving state.

First, when the refrigerant relief device is on standby, electric current is not flowing through the coil 18, so that the movable core 15 is urged by the spring 16 in the direction away from the fixed core 17, to place the piercing rod 14 in a standby position where the tip thereof is away from the metal thin film 12, as shown in FIG. 2.

Now, assuming that in response to detection of leakage of refrigerant from the evaporator by a refrigerant sensor, or detection of collision of the automotive vehicle by an acceleration sensor, for example, pulse current is supplied to the coil 18 e.g. for approximately 20 milliseconds, the movable core 15 is attracted by the fixed core 17 against the urging force of the spring 16. This causes the piercing rod 14 fixed to the movable core 15 to move forward toward the metal thin film 12, and when the movable core 15 is attracted to the fixed core 17, the tip of the piercing rod 14 formed at an acute angle breaks through the metal thin film 12, as shown in FIG. 3.

When pulse current ceases to be supplied to the coil 18, as shown in FIG. 4, the movable core 15 is moved away from the fixed core 17 by the urging force of the spring 16, and the piercing rod 14 is pushed back by refrigerant blowing out from the broken metal thin film 12. After that, as shown in FIG. 5, the metal thin film 12 is burst by the force of the refrigerant blowing out from a hole formed by breaking the metal thin film 12 to increase the size of the hole, so that refrigerant in the refrigeration cycle is instantly released into the atmosphere via the conduit 19. This prevents a large amount of the refrigerant in the refrigeration cycle from releasing into the vehicle compartment, thereby making it possible to prevent a suffocation accident from being caused by the refrigerant having released, or a firing accident from being caused by a fire caught by the refrigerant having released.

Figure 6:
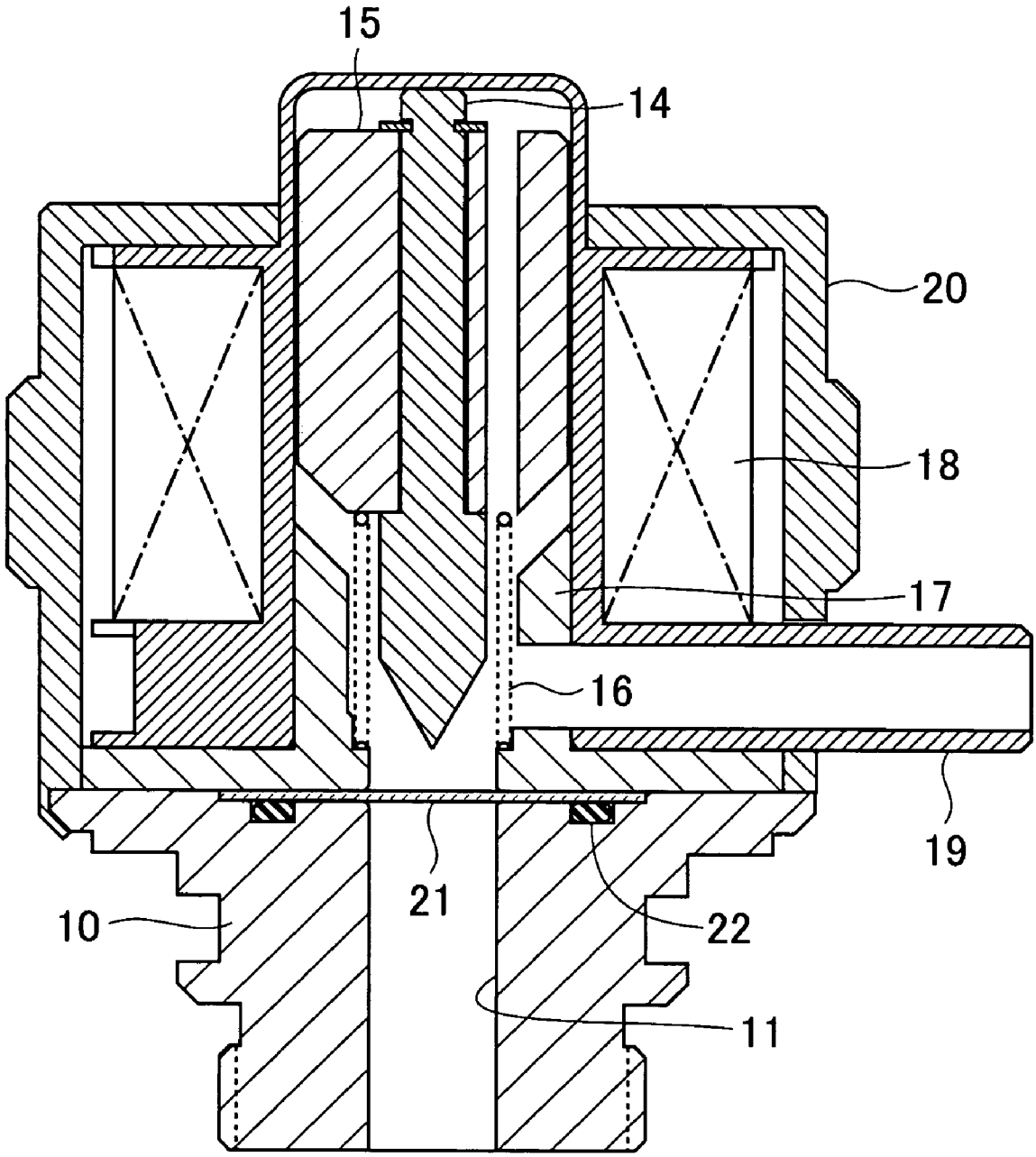
FIG. 6 is a central longitudinal cross-sectional view of the internal construction of a refrigerant relief device according to a second embodiment of the present invention.

FIG. 6 is a central longitudinal cross-sectional view of the internal construction of a refrigerant relief device according to a second embodiment of the present invention. In FIG. 6, component elements identical to those shown in FIG. 2 are designated by identical reference numerals, and detailed description thereof is omitted.

The refrigerant relief device according to the second embodiment is distinguished from the refrigerant relief device according to the first embodiment which employs the metal thin film 12 as a thin film for blocking the refrigerant inlet passage 11, in that it employs a ceramic plate 21 as the thin film. Since the ceramic plate 21 cannot be welded to the body 10, an O ring 22 is disposed between the ceramic plate 21 and the body 10 to prevent leakage of refrigerant. It should be noted that although in the present embodiment, the ceramic plate 21, which is of a fragile material easily breakable by an impact, is used as the thin film, a glass plate may be used.

Figure 7:
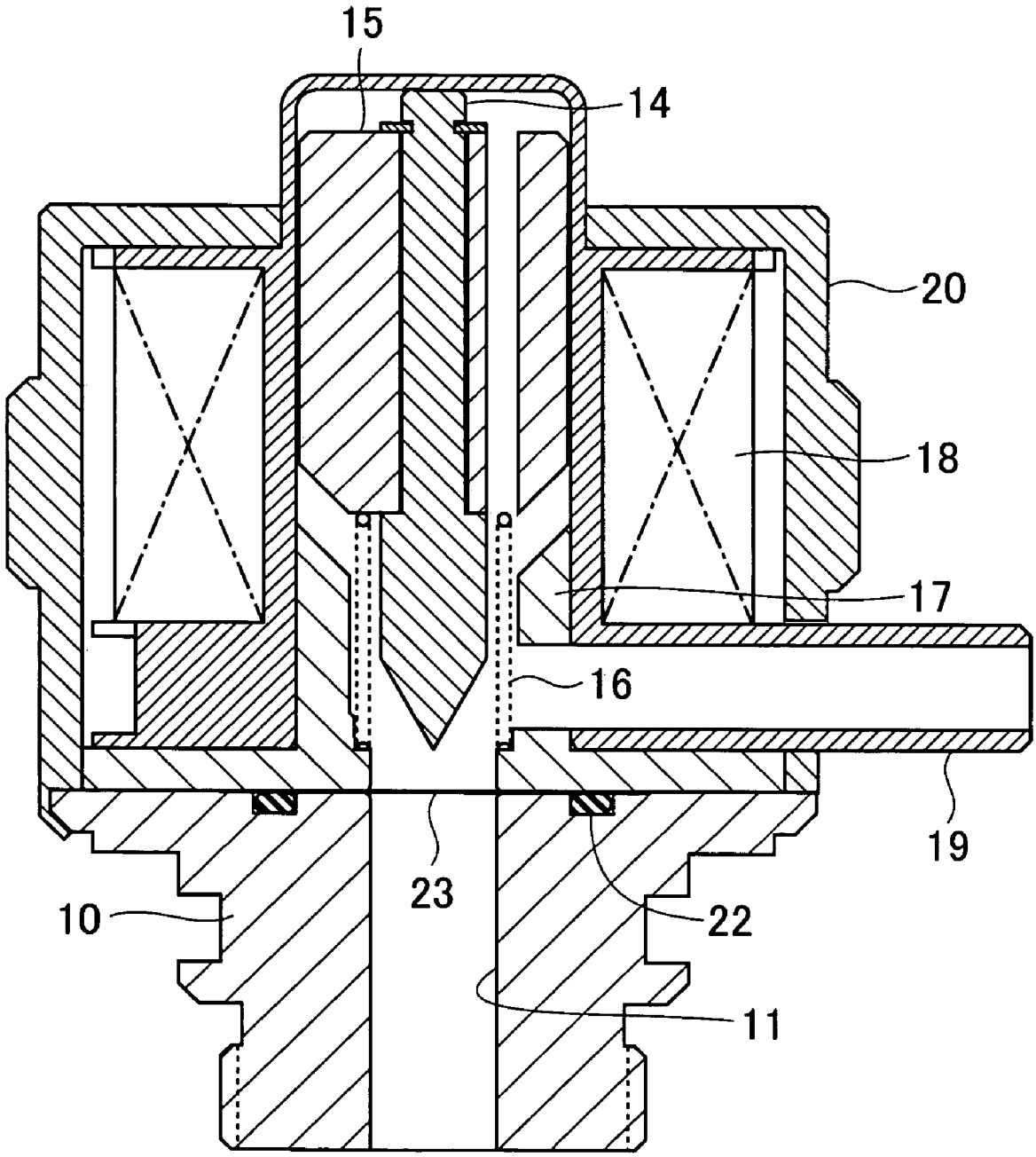
FIG. 7 is a central longitudinal cross-sectional view of the internal construction of a refrigerant relief device according to a third embodiment of the present invention.

FIG. 7 is a central longitudinal cross-sectional view of the internal construction of a refrigerant relief device according to a third embodiment of the present invention. In FIG. 7, component elements identical to those shown in FIG. 6 are designated by identical reference numerals, and detailed description thereof is omitted.

The refrigerant relief device according to the third embodiment is distinguished from the refrigerant relief device according to the second embodiment which employs the ceramic plate 21 as the thin film for blocking the refrigerant inlet passage 11, in that it employs a film 23. Polyimide, for example, can be used as the material of the film 23. Of course, the film 23 may be replaced by a metal thin film 12 that is made of a material different from that of the body 10 and cannot be sealed to the body 10 by welding.

Figure 8:
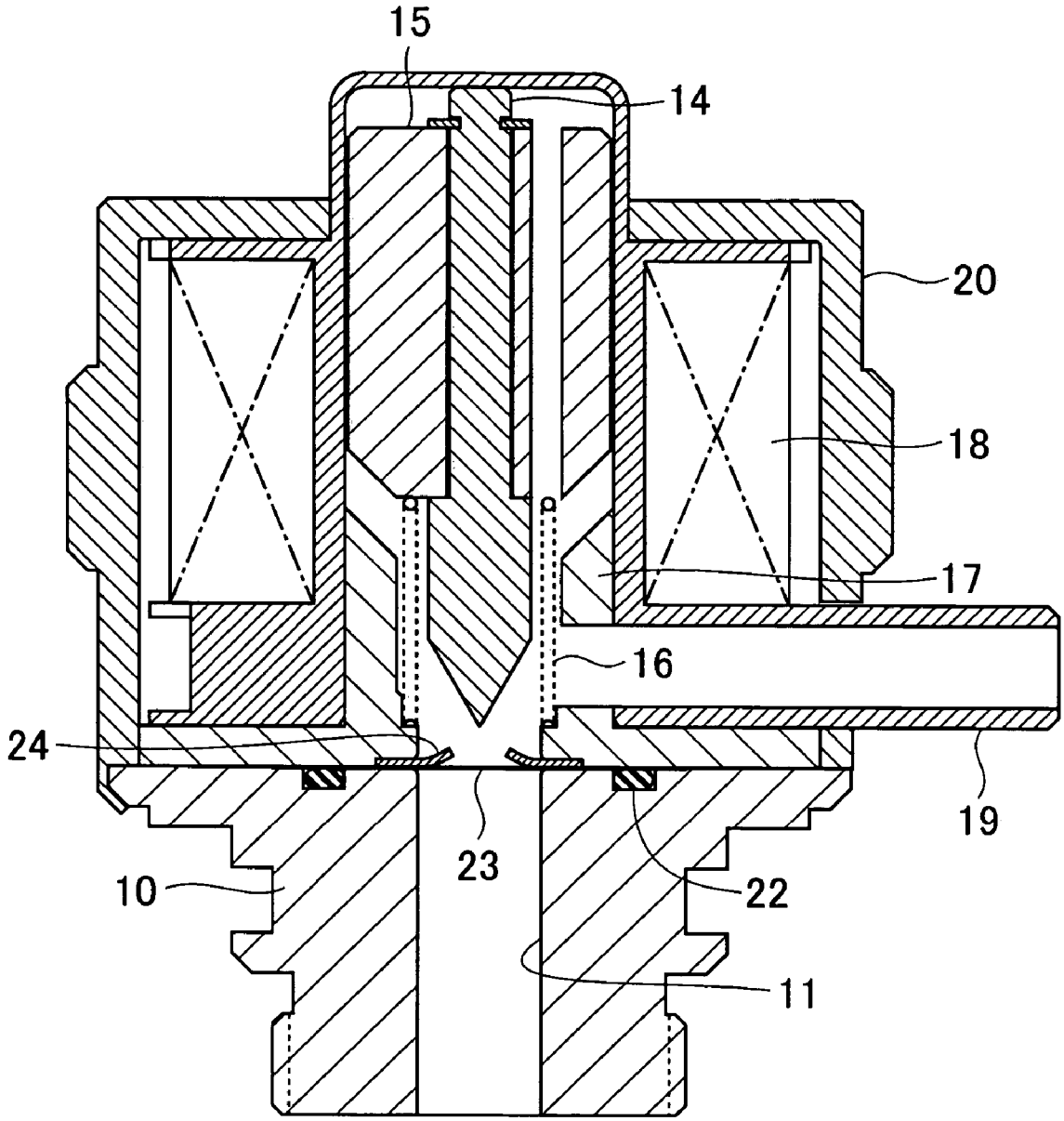
FIG. 8 is a central longitudinal cross-sectional view of the internal construction of a refrigerant relief device according to a fourth embodiment of the present invention.

FIG. 8 is a central longitudinal cross-sectional view of the internal construction of a refrigerant relief device according to a fourth embodiment of the present invention. In FIG. 8, component elements identical to those shown in FIG. 7 are designated by identical reference numerals, and detailed description thereof is omitted.

The refrigerant relief device according to the fourth embodiment includes a retainer 24 for retaining the film 23 from the atmosphere side, as an additional component to the refrigerant relief device according to the third embodiment. The film 23 made of polyimide is sometimes deformed in a manner expanding toward the atmosphere side when it is exposed to pressure of refrigerant in the refrigeration cycle for a long time period, and such deformation of the film 23 is prevented by the retainer 24.

Figure 9:
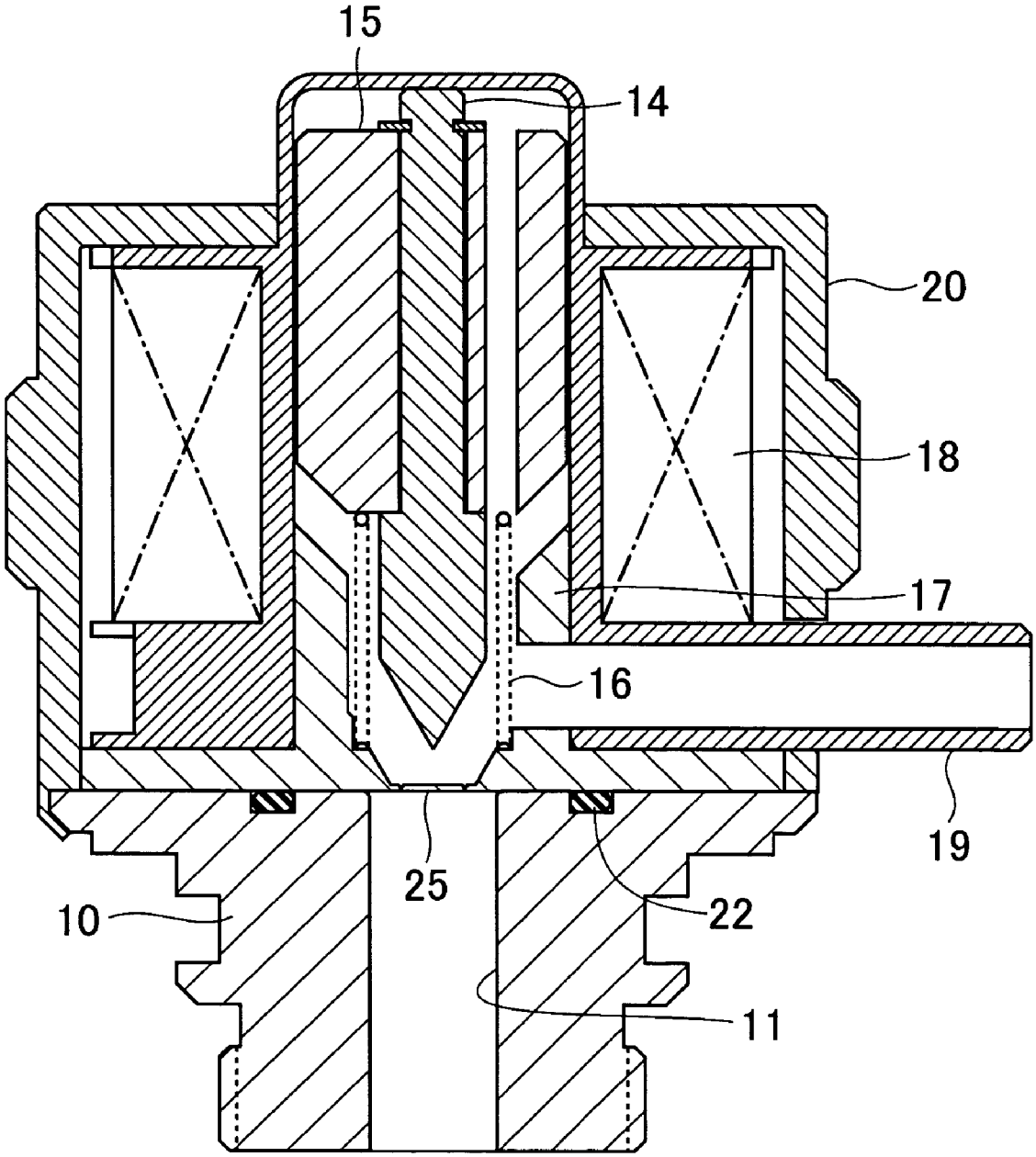
FIG. 9 is a central longitudinal cross-sectional view of the internal construction of a refrigerant relief device according to a fifth embodiment of the present invention.

FIG. 9 is a central longitudinal cross-sectional view of the internal construction of a refrigerant relief device according to a fifth embodiment of the present invention. In FIG. 9, component elements identical to those shown in FIG. 7 are designated by identical reference numerals, and detailed description thereof is omitted.

The refrigerant relief device according to the fifth embodiment has a thin film portion 25 formed by thinning part of metal, as the thin film for blocking the refrigerant inlet passage 11. In the present embodiment, the thin film portion 25 is integrally formed with the fixed core 17 by thinning a wall of the fixed core 17 on the atmosphere side thereof.

Figure 10:
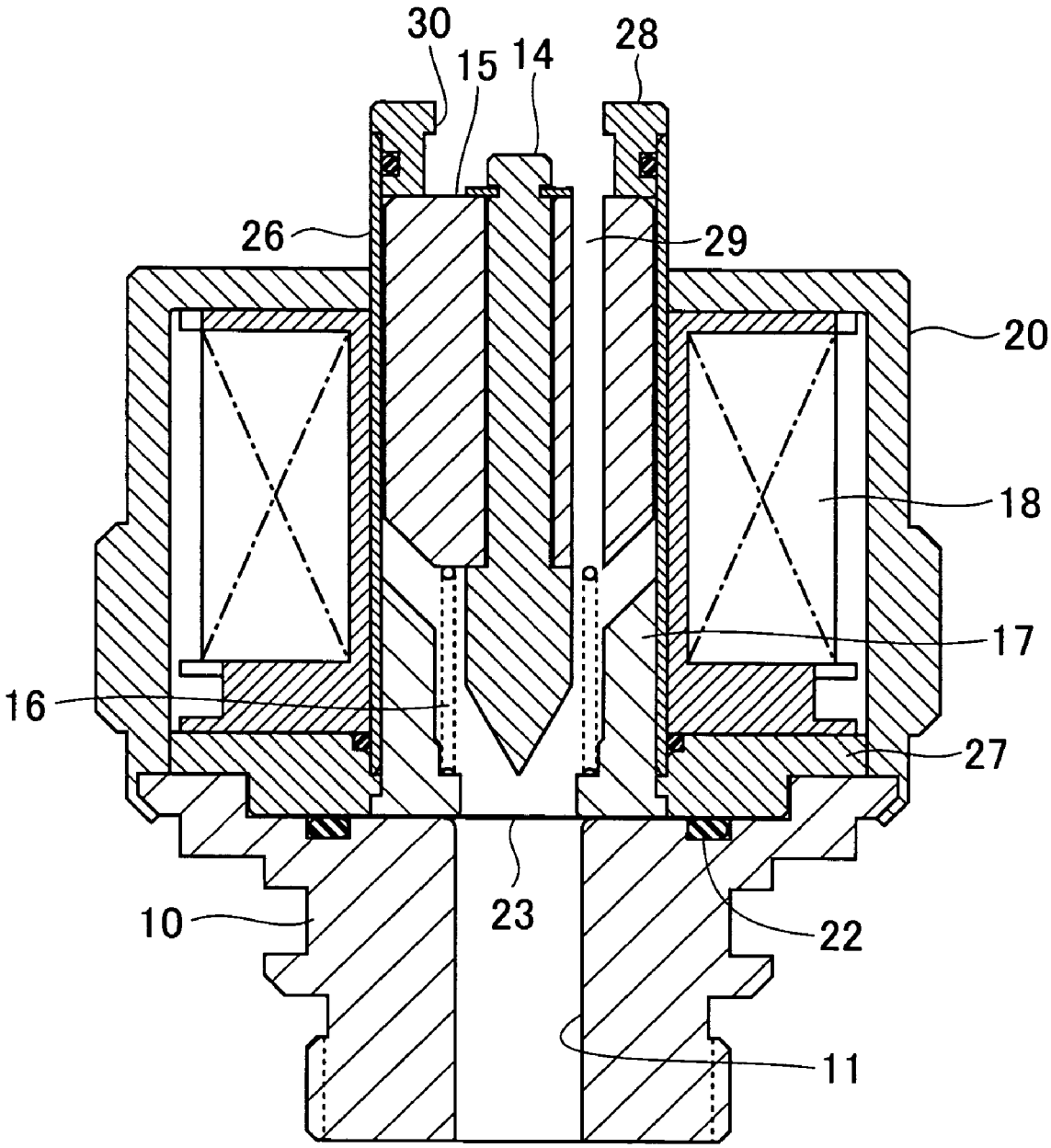
FIG. 10 is a central longitudinal cross-sectional view of the internal construction of a refrigerant relief device according to a sixth embodiment of the present invention.

FIG. 10 is a central longitudinal cross-sectional view of the internal construction of a refrigerant relief device according to a sixth embodiment of the present invention. In FIG. 10, component elements identical to those shown in FIG. 7 are designated by identical reference numerals, and detailed description thereof is omitted.

Although the refrigerant relief devices according to the first to fifth embodiments release refrigerant into the atmosphere through the conduit 19 formed on the lateral side thereof, the refrigerant relief device according to the sixth embodiment is configured to release refrigerant from an upper portion thereof, as viewed in FIG. 10.

More specifically, a sleeve 26 is disposed inside the bobbin for the coil 18, and the fixed core 17 is rigidly fixed to the lower end of the sleeve 26 as viewed in FIG. 10 by press-fitting. Further, a plate 27 for establishing a magnetic circuit between the fixed core 17 and the yoke 20 is fixed to the lower end of the sleeve 26. To the upper end of the sleeve 26 as viewed in FIG. 10 is fixed a stopper 28 for preventing the movable core 15 from moving out of the sleeve 26, and a central portion of the stopper 28 is open to form a refrigerant-releasing hole 30. The movable core 15 has a vent hole 29 extending therethrough in the direction of the length thereof. Therefore, when the film 23 is broken by the piercing rod 14, refrigerant in the refrigeration cycle flows through the vent hole 29 to be released into the atmosphere via the refrigerant-releasing hole 30 formed through the central portion of the stopper 28. It should be noted that since the end of the sleeve 26 having the stopper 28 fitted therein protrudes from the yoke 20, a hose may be connected to the end, for releasing the discharged refrigerant to the atmosphere from a location different from the refrigerant-releasing hole 30.

Figure 11A:
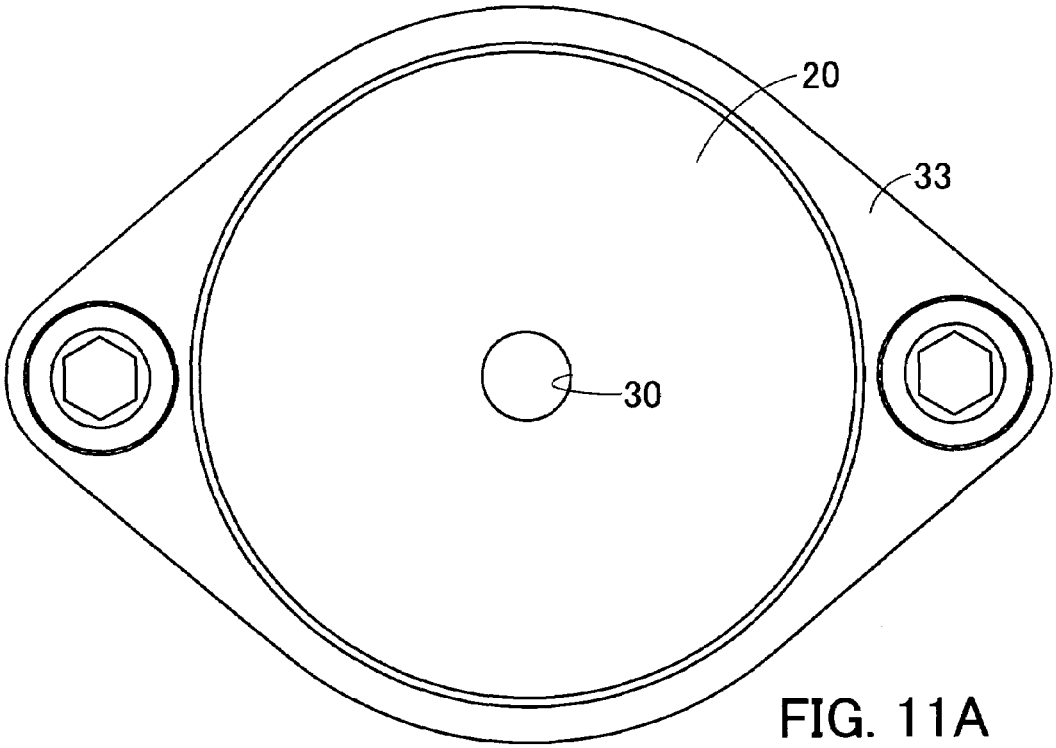
FIGS. 11(A) and 11(B) are views of a refrigerant relief device according to a seventh embodiment of the present invention.
Figure 11B:
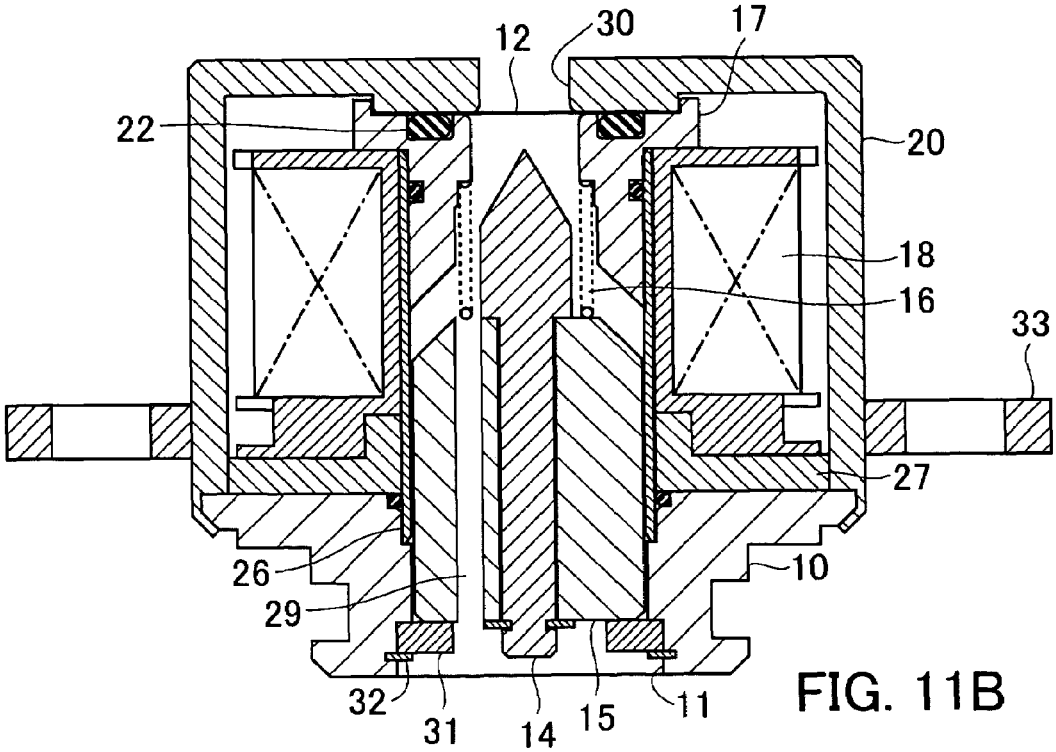

FIGS. 11(A) and 11(B) are diagrams showing a refrigerant relief device according to a seventh embodiment of the present invention, in which FIG. 11(A) is a plan view of the refrigerant relief device, and FIG. 11(B) is a central longitudinal cross-sectional view of the internal construction of the refrigerant relief device. In FIGS. 11(A) and 11(B), component elements identical to those shown in FIG. 10 are designated by identical reference numerals, and detailed description thereof is omitted.

The refrigerant relief device according to the seventh embodiment is distinguished from the refrigerant relief devices according to the first to sixth embodiments in which the thin film-breaking section for breaking the thin film is disposed on the atmosphere side with respect to the thin film, in that the thin film-breaking section is disposed toward the refrigeration cycle with respect to the thin film.

In this refrigerant relief device, the sleeve 26 has a lower end thereof fixed to the refrigerant inlet passage 11 of the body 10, and an upper end thereof fixed to the fixed core 17. Disposed below the fixed core 17, as viewed in FIG. 11(B), is the movable core 15 urged by the spring 16 in the direction away from the fixed core 17, and the piercing rod 14 with the pointed tip thereof directed upward, as viewed in FIG. 11(B), is fixed to the movable core 15. The metal thin film 12 is disposed on an upper end face of the fixed core 17, as viewed in FIG. 11(B). The metal thin film 12 is sandwiched by the fixed core 17 and the yoke 20 formed with the refrigerant-releasing hole 30 therethrough, and sealed by the O ring 22. The movable core 15 is prevented from falling off by a spacer 31 and a C ring 32 disposed in the refrigerant inlet passage 11. A mounting member 33 is fixed to the outer periphery of the yoke 20 e.g. by welding.

The refrigerant relief device is configured such that by energizing the solenoid, the movable core 15 is attracted to the fixed core 17, whereby the piercing rod 14 fixed to the movable core 15 breaks through the metal thin film 12, and when the solenoid is deenergized, the movable core 15 is pushed back by the spring 16 to retract the piercing rod 14 from the metal thin film 12, whereby a refrigerant passage is secured. This allows refrigerant in the refrigeration cycle to pass through the refrigerant inlet passage 11 and the vent hole 29 of the movable core 15 to be released into the atmosphere via a hole formed by breakage of the metal thin film 12 by the piercing rod 14, and the refrigerant-releasing hole 30.

Figure 12:
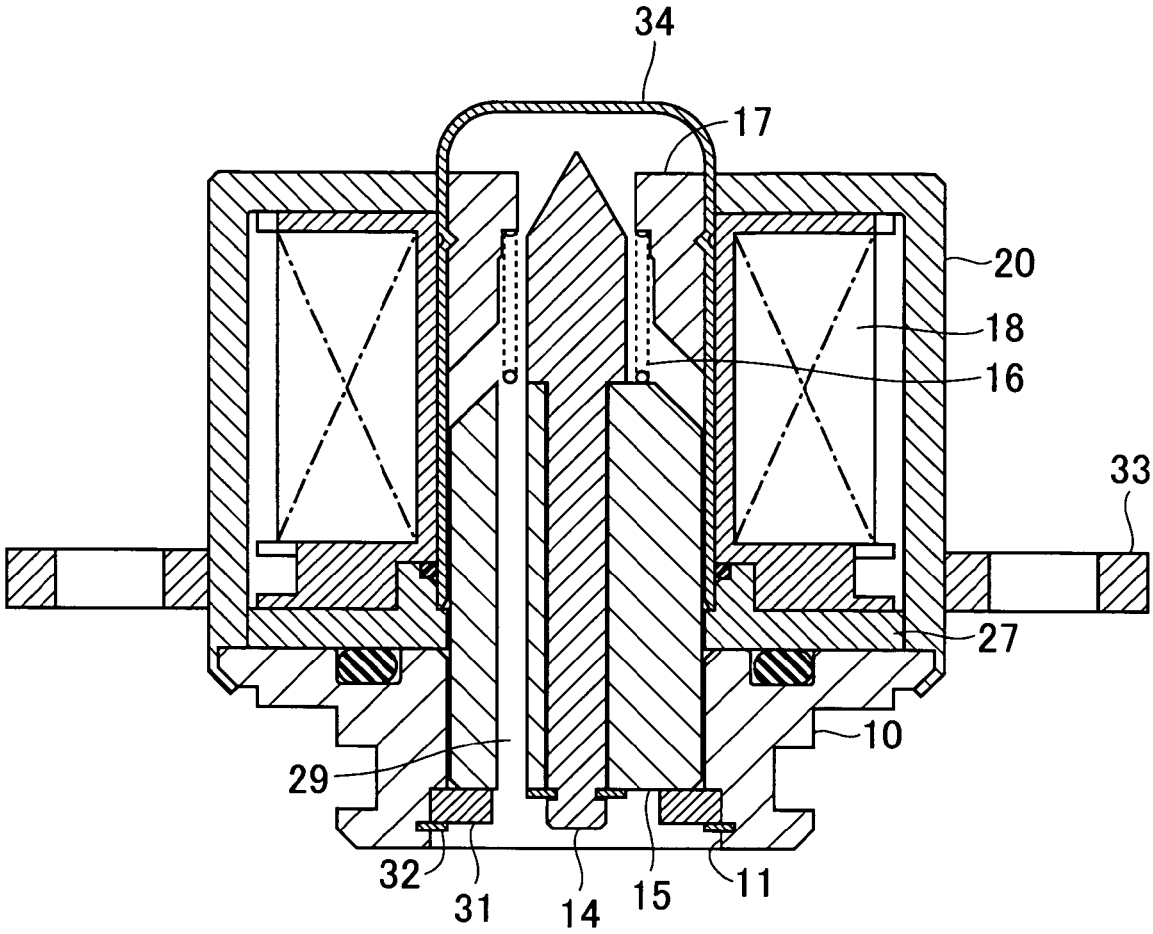
FIG. 12 is a central longitudinal cross-sectional view of the internal construction of a refrigerant relief device according to an eighth embodiment of the present invention.

FIG. 12 is a central longitudinal cross-sectional view of the internal construction of a refrigerant relief device according to an eighth embodiment of the present invention. In FIG. 12, component elements identical to those shown in FIG. 11 are designated by identical reference numerals, and detailed description thereof is omitted.

The refrigerant relief device according to the eighth embodiment is configured such that the thin film is formed by a bottomed sleeve 34, and a bottom of the bottomed sleeve 34 is broken through by the piercing rod 14. More specifically, the bottomed sleeve 34 is disposed inside the bobbin for the coil 18 in a manner such that the bottom thereof protrudes from a central opening of the yoke 20, and a lower open end of the bottomed sleeve 34, as viewed in FIG. 12, is fixed to an opening-defining portion of the plate 27. The bottomed sleeve 34 contains the fixed core 17 fixed thereto by coulking, and the movable core 15 urged by the spring 16 in the direction away from the fixed core 17 is disposed at a location below the fixed core 17. The piercing rod 14 is fixed to the movable core 15 such that the pointed tip thereof is opposed to the bottom of the bottomed sleeve 34.

With this construction, when the solenoid is energized, the movable core 15 is attracted to the fixed core 17, whereby the piercing rod 14 fixed to the movable core 15 breaks through the bottom of the bottomed sleeve 34 to make a hole therethrough. When the solenoid is deenergized, the movable core 15 is pushed back by the spring 16, whereby the piercing rod 14 is retracted from the bottom of the bottomed sleeve 34, so that refrigerant in the refrigeration cycle is released to the atmosphere by way of the refrigerant inlet passage 11, the vent hole 29 of the movable core 15, and the hole formed by breakage of the bottom of the bottomed sleeve 34.

Figure 13:
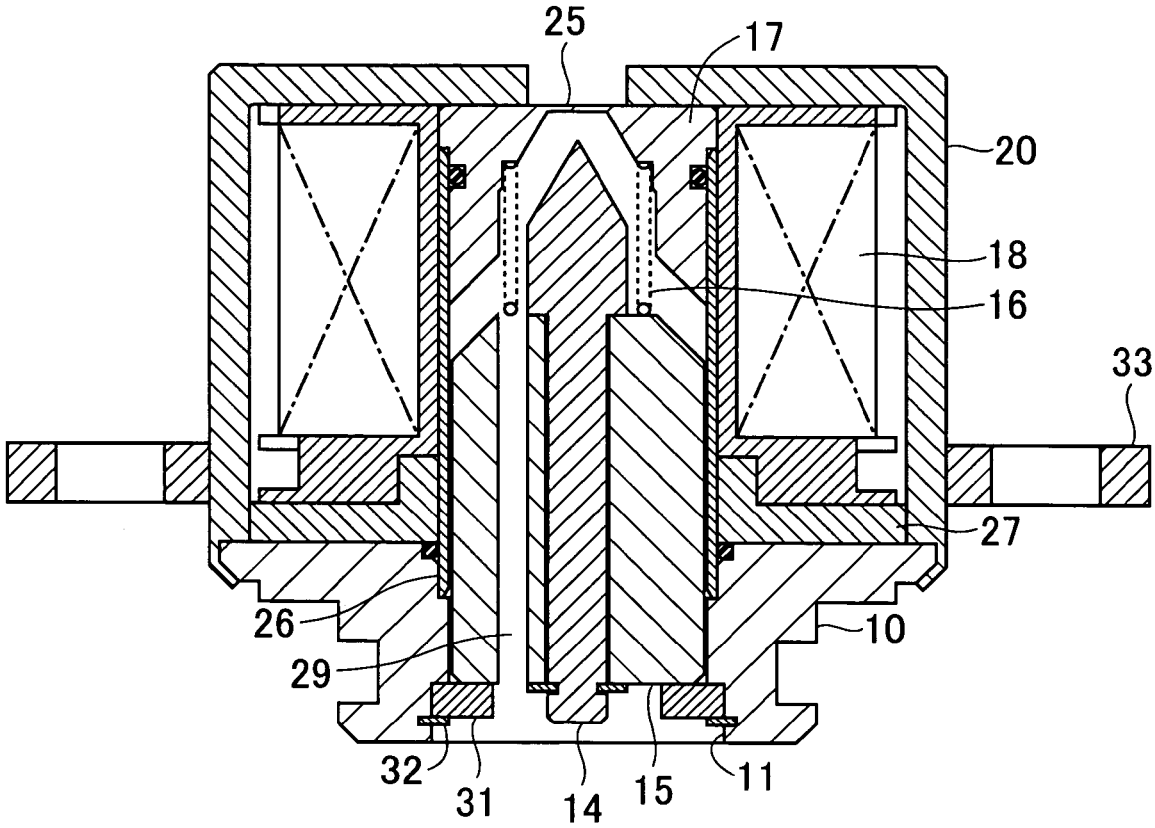
FIG. 13 is a central longitudinal cross-sectional view of the internal construction of a refrigerant relief device according to a ninth embodiment of the present invention.

FIG. 13 is a central longitudinal cross-sectional view of the internal construction of a refrigerant relief device according to a ninth embodiment of the present invention. In FIG. 13, component elements identical to those shown in FIG. 11 are designated by identical reference numerals, and detailed description thereof is omitted.

The refrigerant relief device according to the ninth embodiment is configured such that the thin film-breaking section for breaking the thin film is disposed inside the thin film, and the thin film is configured as the thin film portion 25 formed by thinning part of metal. In this embodiment, the thin film portion 25 is integrally formed with the fixed core 17. When the movable core 15 is attracted to the fixed core 17 by energization of the solenoid, the piercing rod 14 fixed to the movable core 15 breaks through the thin film portion 25 of the fixed core 17 to make a hole therethrough.

Figure 14:
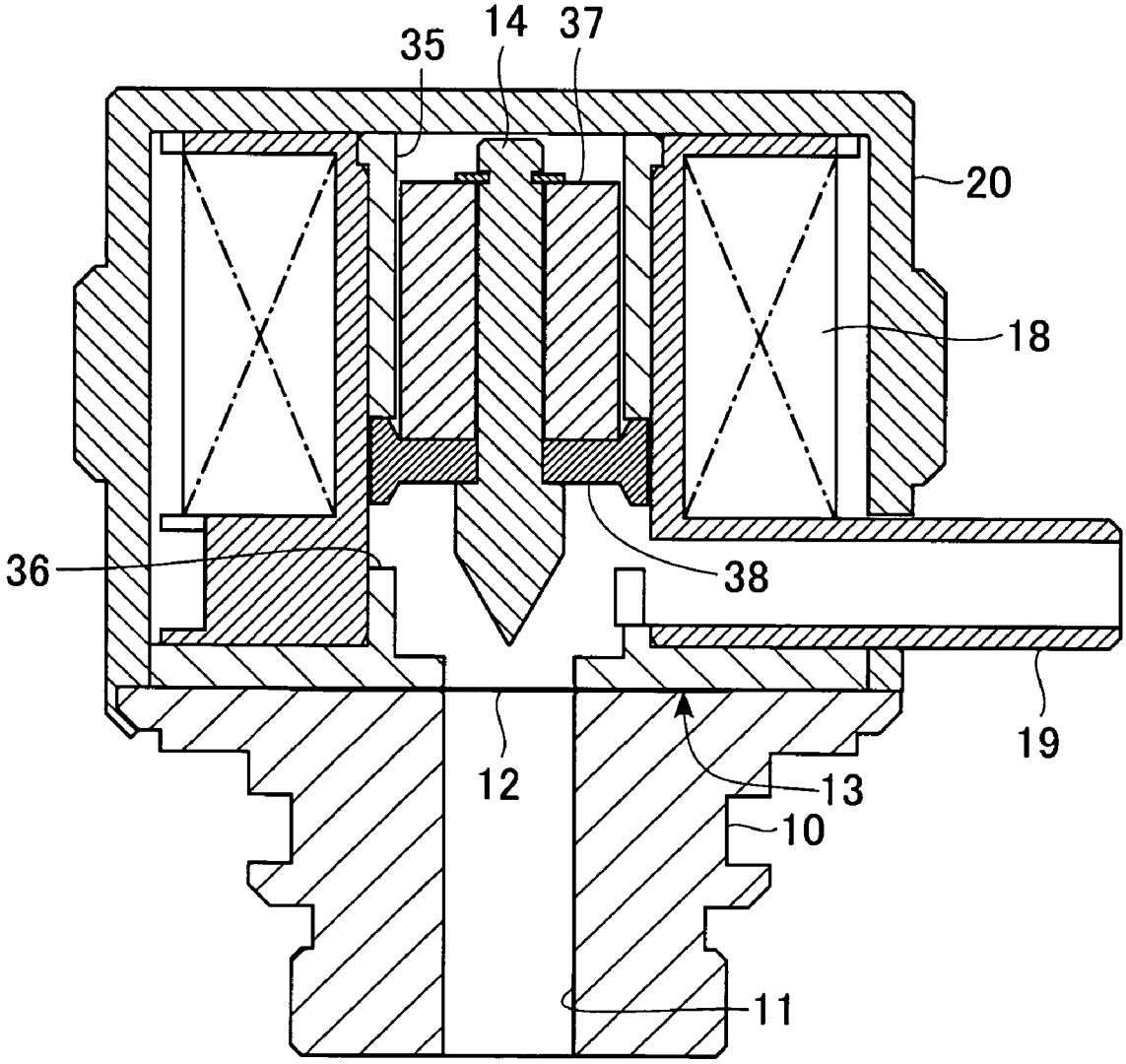
FIG. 14 is a central longitudinal cross-sectional view of the internal construction of a refrigerant relief device according to a tenth embodiment of the present invention.

FIG. 14 is a central longitudinal cross-sectional view of the internal construction of a refrigerant relief device according to a tenth embodiment of the present invention. In FIG. 14, component elements identical to those shown in FIG. 2 are designated by identical reference numerals, and detailed description thereof is omitted.

The refrigerant relief device according to the tenth embodiment is distinguished from the refrigerant relief devices according to the first to tenth embodiments which are configured to obtain the thrust of the piercing rod 14 by the solenoid, in that it is configured to obtain the thrust of the piercing rod 14 by attractive force and repulsive force generated between a permanent magnet and an electromagnet.

According to the refrigerant relief device of the tenth embodiment, the electromagnet comprises the coil 18, a first iron core 35 in the form of a hollow cylinder and a second iron core 36 in the form of a hollow cylinder having a flange, both of which are arranged within the bobbin for the coil 18, and the yoke 20. The first iron core 35 and the second iron core 35 are positioned apart from each other, and end faces thereof opposed to each other are magnetized to the N pole or the S pole depending on the polarity of pulse current supplied to the coil 18.

The permanent magnet 37 is disposed in the first iron core 35 in a manner axially movable forward and backward, and an iron piece 38 and the piercing rod 14 are fixed to the permanent magnet 37. The iron piece 38 is magnetized to the polarity of an end of the permanent magnet 37 having the iron piece 38 fixed thereto. The iron piece 38 is in the form of a disk which is H-shaped in cross section, and its periphery is located between the opposed end faces of the first iron core 35 and the second iron core 36. The iron piece 38 magnetized by the permanent magnet 37 is attracted to the first iron core 35 to be stopped in a position shown in FIG. 14 when the refrigerant relief device is on standby. In other words, the iron piece 38 is attracted to the first iron core 35 to hold itself in the attracted position.

In the refrigerant relief device constructed as above, let it be assumed that when pulse current in a certain direction is supplied to the coil 18, the end face of the first iron core 35 to which the iron piece 38 is attracted is magnetized to the same pole as the pole to which the iron piece 38 is magnetized by the permanent magnet 37, and the end face of the second iron core 36 opposed to the end face of the first iron core 35 is magnetized to a pole having a polarity opposite to the polarity of the end face of the first iron core 35. This makes the iron piece 38 and the first iron core 35 repulsive to each other, and the iron piece 38 and the second iron core 36 attractive to each other, so that the iron piece 38 is moved toward the second iron core 36 to be attracted thereto. At this time, the piercing rod 14 breaks through the metal thin film 12 to make a hole therethrough.

Then, when pulse current in the opposite direction is supplied to the coil 18, the iron piece 38 and the first iron core 35 are made attractive to each other, and the iron piece 38 and the second iron core 36 are made repulsive to each other, so that the iron piece 38 acts to pull back the piercing rod 14 from the metal thin film 12, and refrigerant blowing out through the formed hole acts to push back the piercing rod 14, whereby the iron piece 38 is eventually attracted to the first iron core 35 to retract the piercing rod 14 from the metal thin film 12.

Figure 15:
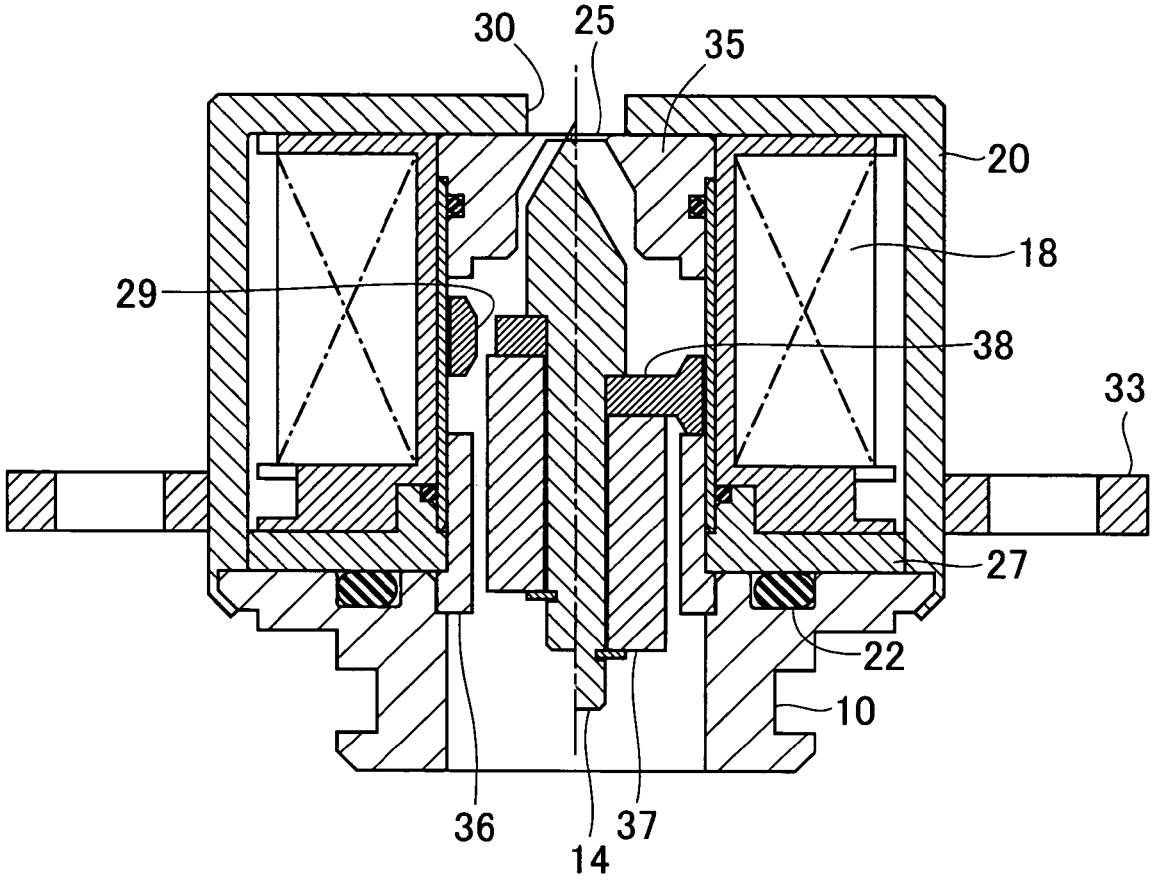
FIG. 15 is a central longitudinal cross-sectional view of the internal construction of a refrigerant relief device according to an eleventh embodiment of the present invention.

FIG. 15 is a central longitudinal cross-sectional view of the internal construction of a refrigerant relief device according to an eleventh embodiment of the present invention. In FIG. 15, component elements identical to those shown in FIG. 14 are designated by identical reference numerals, and detailed description thereof is omitted. It should be noted that in FIG. 16, so as to simultaneously show two states of the refrigerant relief device in which it is in the respective operating positions, the right half of FIG. 15 shows a standby state of the refrigerant relief device, while the left half of the same shows an operating state of the same.

The refrigerant relief device according to the eleventh embodiment is distinguished from the refrigerant relief device according to the tenth embodiment in which the thin film-breaking device is disposed outside the thin film, in that the thin film-breaking device is disposed inside the thin film, that the thin film for blocking the refrigerant inlet passage 11 is implemented by the thin film portion 25 formed by thinning a central portion of the first iron core 35, that the conduit 19 for releasing refrigerant is replaced by the refrigerant-releasing hole 30 formed through the yoke 20, and further that the mounting member 33 is fixed to the outer periphery of the yoke 20.

In this refrigerant relief device, the outer diameter of the permanent magnet 37 is reduced to form a passage between the permanent magnet 37 and the second iron core 36, and the iron piece 38 is formed with the vent hole 29 axially extending therethrough. Further, the second iron core 36 has a hollow cylindrical shape, and between the same and the yoke 20 is disposed the plate 27 for establishing a magnetic circuit. Furthermore, the iron piece 38 is attracted to the second iron core 36 in the standby state of the refrigerant relief device.

In the refrigerant relief device constructed as above, e.g. when positive pulse current is supplied to the coil 18, the iron piece 38 acts such that it is repulsive to the second iron core 36 and attractive to the first iron core 35, so as to be attracted to the first iron core 35, whereby the piercing rod 14 breaks through the thin film portion 25 of the first iron core 35 to make a hole therethrough. Subsequently, when negative pulse current is supplied to the coil 18, the iron piece 38 acts such that it is repulsive to the first iron core 35, and attractive to the second iron core 36, so as to be attracted to the second iron core 36, whereby the piercing rod 14 is returned to its standby position. As a result, refrigerant is released from the refrigerant-releasing hole 30 into the atmosphere after passing through the refrigerant inlet passage 11, a gap between the second iron core 36 and the permanent magnet 37, the vent hole 29 of the iron piece 38, and the hole formed through the thin film portion 25.

Figure 16:
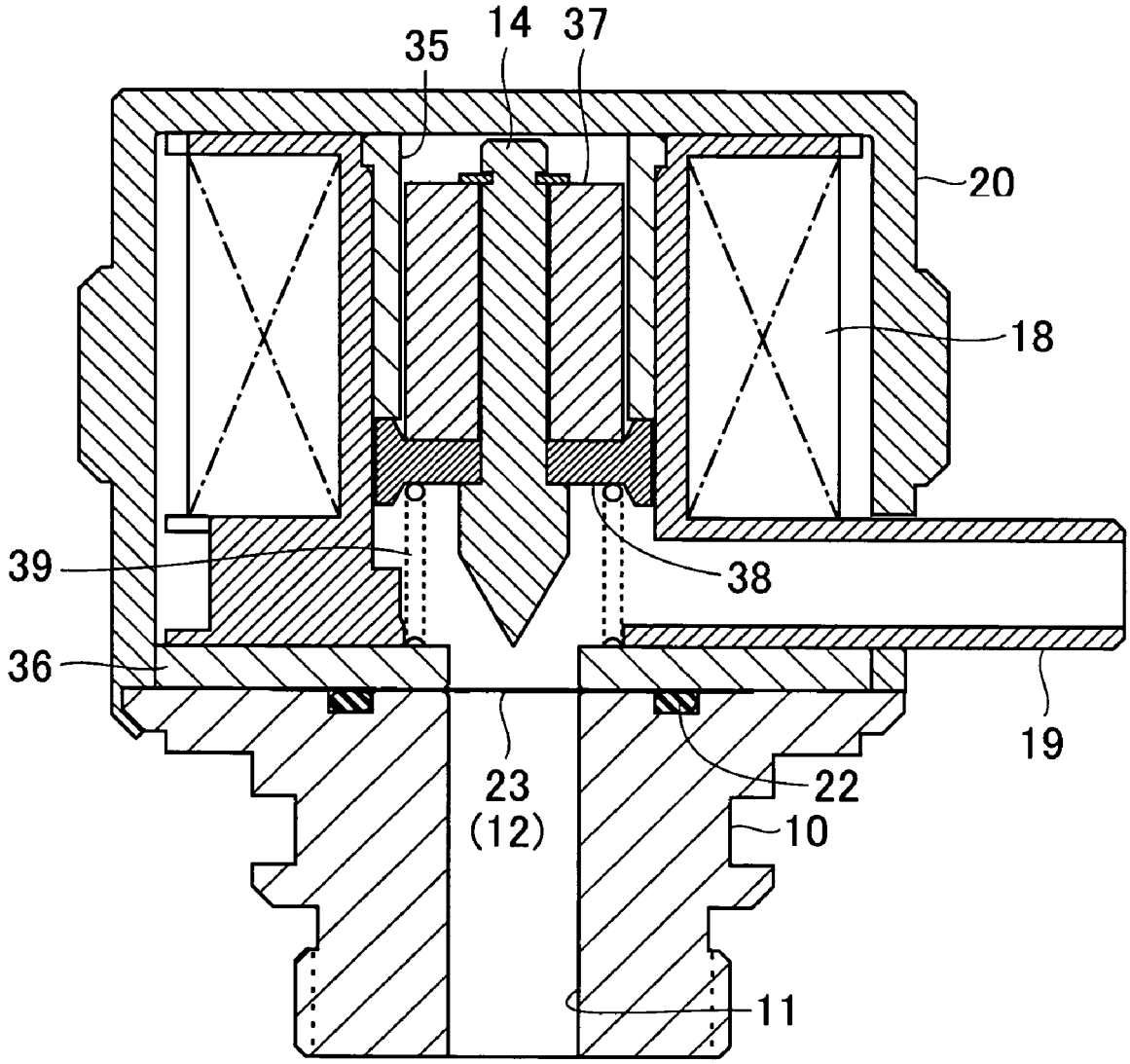
FIG. 16 is a central longitudinal cross-sectional view of the internal construction of a refrigerant relief device according to a twelfth embodiment of the present invention.

FIG. 16 is a central longitudinal cross-sectional view of the internal construction of a refrigerant relief device according to a twelfth embodiment of the present invention. In FIG. 16, component elements identical to those shown in FIG. 14 are designated by identical reference numerals, and detailed description thereof is omitted.

The refrigerant relief device according to the twelfth embodiment is distinguished from the refrigerant relief device according to the tenth embodiment in which the metal thin film 12 made of the same material as that of the body 10 is used as the thin film for blocking the refrigerant inlet passage 11, and is sealed to the body 10 by welding the same thereto, in that the film 23 or the metal thin film 12 made of a different material from that of the body 10 is used, and sealed by the O ring 22, and that the operation of the piercing rod 14 returning to the standby position after breaking the film 23 is caused not by application of pulse current of the opposite polarity but by a spring 39. To this end, this refrigerant relief device has the spring 39 disposed between the iron piece 38 and the second iron core 36 in the form of a plate.

According to the refrigerant relief device, when pulse current is supplied to the coil 18, the iron piece 38 is made repulsive to the first iron core 35, and attractive to the second iron core 36 to thereby move toward the second iron core 36 until it is brought into abutment with a stepped portion of the bobbin, whereby the piercing rod 14 breaks through the film 23 to make a hole therethrough. After that, when the supply of the pulse current is stopped, the iron piece 38, the permanent magnet 37, and the piercing rod 14 are urged upward, as viewed in FIG. 16, by the spring 39, and stopped when the iron piece 38 is stuck to the first iron core 35. This causes refrigerant to be released from the conduit 19 into the atmosphere after passing through the refrigerant inlet passage 11 and the hole formed through the film 23.

Figure 17:
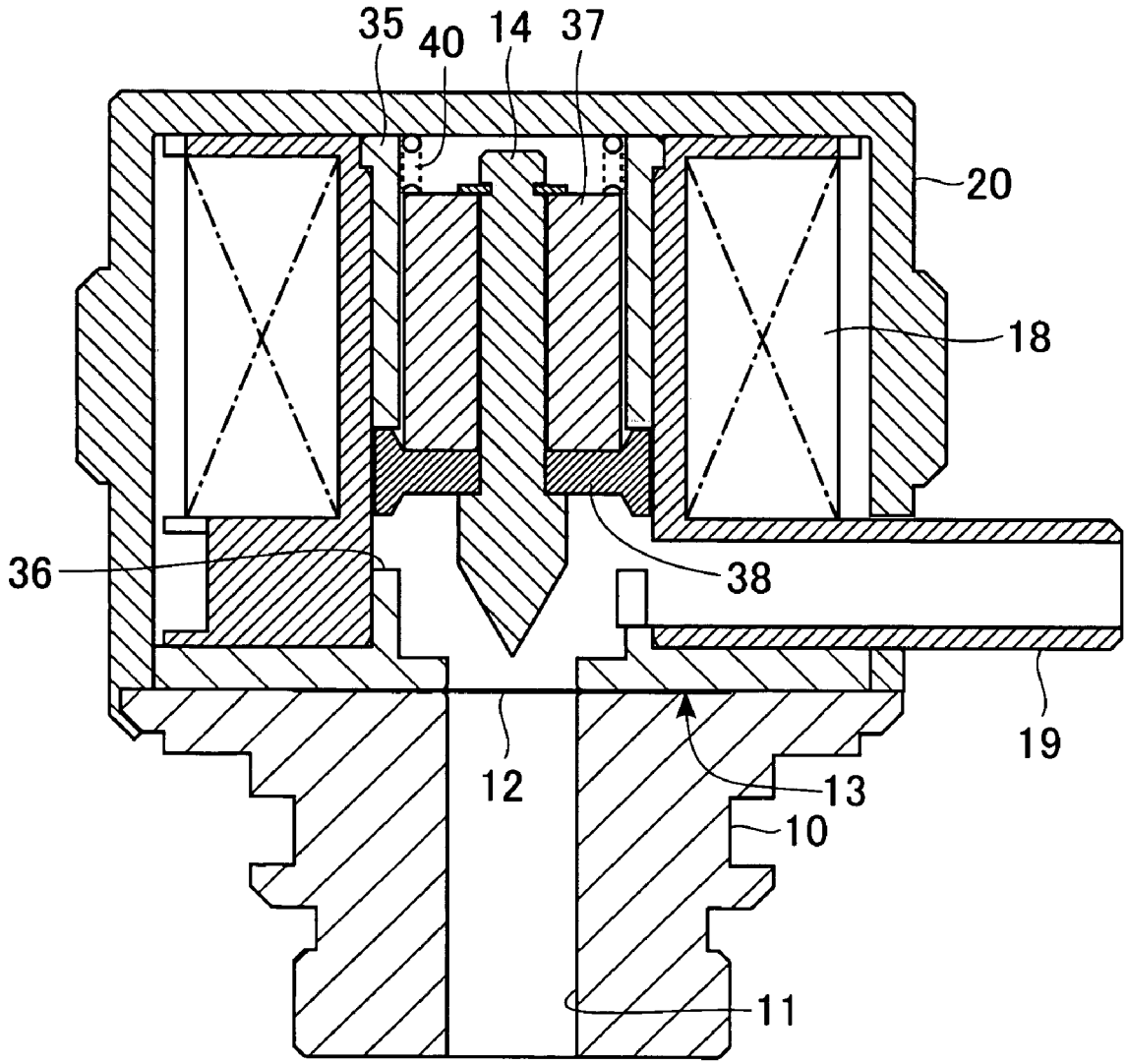
FIG. 17 is a central longitudinal cross-sectional view of the internal construction of a refrigerant relief device according to a thirteenth embodiment of the present invention.

FIG. 17 is a central longitudinal cross-sectional view of the internal construction of a refrigerant relief device according to a thirteenth embodiment of the present invention. In FIG. 17, component elements identical to those shown in FIG. 16 are designated by identical reference numerals, and detailed description thereof is omitted.

The refrigerant relief device according to the thirteenth embodiment is formed by adding a component for increasing the force with which the piercing rod 14 breaks through the metal thin film 12, to the refrigerant relief device according to the tenth embodiment. More specifically, this refrigerant relief device has a spring 40 disposed between the permanent magnet 37 and the yoke 20.

With this arrangement, when pulse current in a certain direction is supplied to the coil 18, not only the iron piece 38 and the first iron core 35 are made repulsive to each other and the iron piece 38 and the second iron core 36 attractive to each other, but also the urging force of the spring 40 is applied to assist in causing the piercing rod 14 to be thrust toward the metal thin film 12. This causes the piercing rod 14 to hit against the metal thin film 12 after increasing its initial speed produced by the electromagnetic force, so that it is possible to break the metal thin film 12 more positively.

Subsequently, when pulse current in the opposite direction is supplied to the coil 18, the iron piece 38 is pulled back to be attracted to the first iron core 35, and refrigerant blows out from the hole formed through the metal thin film 12 to be released from the conduit 19 into the atmosphere.

Since the refrigerant relief device according to the present invention comprises the thin film and the thin film-breaking section, it is possible to provide a refrigerant relief device which is simple in construction, and therefore manufactured at low costs.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A refrigerant relief device for releasing refrigerant filled in a refrigeration cycle for an automotive air conditioner into the atmosphere, comprising:

a thin film disposed in a manner blocking a refrigerant inlet passage connected to the refrigeration cycle; and a thin film-breaking section for breaking the thin film to thereby release the refrigerant introduced from the refrigeration cycle into the refrigerant inlet passage into the atmosphere;

wherein the thin film-breaking section includes a piercing rod that is disposed in a manner movable forward and backward in a direction perpendicular to a plane of the thin film and has a tip facing the thin film and formed to have a pointed shape, and a thrust-generating section that generates a thrust for moving the piercing rod in forward and backward directions thereof.

2. The refrigerant relief device according to claim 1, wherein the thrust-generating section is a solenoid configured such that a movable core urged in a direction away from a fixed core disposed on a side where the thin film exists has the piercing rod fixed thereto.

3. The refrigerant relief device according to claim 1, wherein the thrust-generating section includes a permanent magnet for holding the piercing rod in a manner movable in the forward and backward directions thereof, and an electromagnet for driving the permanent magnet in forward and backward directions thereof, the electromagnet having an iron core divided apart in the forward and backward directions of the permanent magnet, and an iron piece fixed to the permanent magnet such that the iron piece is positioned between opposed end faces of the iron core, for being attracted and repelled by the iron core.

4. The refrigerant relief device according to claim 3, wherein the thrust-generating section has a spring urging the permanent magnet in a direction in which the piercing rod moves forward to the thin film.

5. The refrigerant relief device according to claim 3, wherein the thrust-generating section has a spring urging the permanent magnet in a direction in which the piercing rod moves backward from the thin film.

6. The refrigerant relief device according to claim 3, wherein the piercing rod is caused to hold itself in a standby position by the permanent magnet being attracted to the iron core.

7. The refrigerant relief device according to claim 1, wherein the thin film-breaking section is disposed on a side of the thin film toward the atmosphere.

8. The refrigerant relief device according to claim 1, wherein the thin film-breaking section is disposed toward the refrigerant inlet passage with respect to the thin film.

9. The refrigerant relief device according to claim 1, wherein the thin film is a metal thin film made of a same kind of material as a material of a body forming the refrigerant inlet passage, the thin film being welded to the body.

10. The refrigerant relief device according to claim 1, wherein the thin film is made of a material different from a material of a body forming the refrigerant inlet passage, the thin film being brought into intimate contact with the body forming the refrigerant inlet passage by a sealing member.

11. The refrigerant relief device according to claim 1, wherein the thin film is one of members constituting the thin film-breaking section, and formed such that at least a portion thereof opposed to a tip of the piercing rod is thin.

12. The refrigerant relief device according to claim 1, wherein the thin film is a bottom of a bottomed sleeve that has an open end connected to the refrigerant inlet passage and contains a movable portion of the thin film-breaking section.

* * * * *